United States Patent [19]

Sasaki

[11] Patent Number: 4,609,031

[45] Date of Patent: Sep. 2, 1986

[54] SYSTEM FOR SINTERING MOLDS AND FOR PREPARING CAST PRODUCTS

[75] Inventor: Nobuyoshi Sasaki, Yokohama, Japan

[73] Assignee: M.C.L. Co., Ltd., Kanagawa, Japan

[21] Appl. No.: 623,384

[22] Filed: Jun. 22, 1984

[30] Foreign Application Priority Data

Jul. 4, 1983 [JP] Japan ..... 58-120323

[51] Int. Cl.[4] ..... B22D 27/00

[52] U.S. Cl. ..... 164/270.1

[58] Field of Search ..... 164/322, 323, 329, 338.1, 164/348, 34, 35, 269, 270.1

[56] References Cited

U.S. PATENT DOCUMENTS

| | | | |
|---|---|---|---|
| 3,485,681 | 12/1969 | Greenwald, Jr. | 164/322 |
| 4,175,610 | 11/1979 | Zauhar et al. | 164/322 |
| 4,225,121 | 10/1980 | Meyer et al. | 266/130 |

FOREIGN PATENT DOCUMENTS

| | | | |
|---|---|---|---|
| 2855128 | 8/1979 | Fed. Rep. of Germany | 164/323 |
| 1586372 | 3/1981 | United Kingdom | 164/338.1 |

*Primary Examiner*—Nicholas P. Godici
*Assistant Examiner*—G. M. Reid
*Attorney, Agent, or Firm*—Laff, Whitesel, Conte & Saret

[57] ABSTRACT

A system for sintering molds and for preparing cast products by the use of the thus preformed molds is provided. The system is particularly suited for the production of cast articles made of an alloy, such as magnesium alloys, which is susceptible to cracking unless the cast mass is slowly cooled at least across the solid solution forming temperature range. The system comprises a composite sintering-annealing furnace including a sintering furnace section and an annealing furnace section. The sintering and annealing furnace sections are juxtaposed to be adjacent with each other and separated by a partition wall through which a plurality of ventilation windows is formed for communicating both sections with each other. A plurality of atmospheric air inlet ports is provided through an external wall defining the annealing furnace section. The temperature in the annealing furnace and the distribution thereof are selectively controlled by changing the mixing ratio of the hot combustion gas sucked from the sintering furnace section to the cold atmospheric air introduced through the air inlet ports. The system further comprises a casting device and a cooling device for effecting initial rapid cooling of the hot cast mass.

12 Claims, 6 Drawing Figures

SYSTEM FOR SINTERING MOLDS AND FOR PREPARING CAST PRODUCTS

BACKGROUND OF THE INVENTION

1. Field of Art;

The present invention relates generally to a casting system which is particularly suited for the mass production of cast articles. More particularly, it relates to a system for sintering molds and for molding cast products in a continuous sequence, the molding steps including the step of casting a molten metal material into the sintered molds and the step of cooling the cast material contained in the molds. In the system of the invention, the cooling step is divided into two-stage operations including an initial rapid cooling operation and a subsequent slow cooling operation effected at a controlled rate. The system of the invention affords eminent advantages when used for the production of cast articles made of a material susceptible to cracking due to improper cooling.

Typical examples of such material are casting grade magnesium alloys which have generally wide temperature range within which they are in the solid solution phase. Such temperature range will be referred to as "solid solution forming temperature range" throughout the following description and in the appended claims. Furthermore, cast magnesium alloys immediately after solidification thereof have inferior strength to those of other cast alloys including aluminum alloys. For these reasons, the cooling rate for solidifying a magnesium alloy should be strictly controlled in order to prevent increase in internal stress, due to shrinkage upon solidification, which might cause cracking at a portion having a thin or uneven wall thickness, such a cracking being induced by the interaction between the shrinking cast alloy and the mold containing the same.

2. Prior Art;

In the conventional technology, it has been a common practice to control the cooling rate for suppressing extreme internal stress which often induces adverse cracking, by cooling the cast alloy slowly in an annealing furnace over a sufficient time period. However, in consideration of the efficiency and the running cost of the entire system, it is desirous that the time required for the overall cooling should be decreased as short as possible. In this connection, the known prior art system is not fully satisfactory, since a long cooling time is necessitated to lower the efficiency thereof.

On the other hand, if the cooling time is simply decreased in the prior art system, extreme difficulties are encountered to produce faultless cast articles at high yield due to the aforementioned cracking problem.

Another disadvantage of the prior art system resides in that the sintering furnace for sintering therein molds and the annealing furnace for slowly cooling the cast alloy or metal contained in the molds, both having considerably large dimensions particularly being long in lengthwise dimension to require vast areas, are built independently at separate locations. With such arrangement, a large area is necessary for the entire system installation. In addition, piping and other concomitant fitting members are indispensable for combining the sintering furnace with the annealing furnace, leading to increase in investment.

Furthermore, the down time of any one or two of the sintering furnace, the casting device and the annealing furnace is often increased because of the difficulty in well timing the operation time throughout the system.

OBJECTS AND SUMMARY OF THE INVENTION

Accordingly, an object of the invention is to provide a system which is compactly assembled to minimize the space or area requirement therefor.

Another object of the invention is to provide a system by which the time necessary for the overall cooling time can be minimized while being capable of producing faultless cast articles at high efficiency.

A further object of the invention is to provide a system comprising a plurality of processing stations arranged sequentially with little dead space.

A more specific object of the invention is to provide a system well suited for mass production of cast articles made of a material which poses difficult problems in casting operations, such as magnesium alloys.

A still further object of the invention is to provide a system in which the sintering furnace for sintering molds therein and the annealing furnace for effecting slow and controlled cooling are juxtaposed, preferably being stacked in the vertical direction, to minimize the area required for the entire system and to improve the efficiency while saving energy and running cost.

Yet a further object of the invention is to provide a system in which the cooling step is divided into the initial rapid cooling operation and the subsequent slow cooling operation to decrease the overall cooling time within the limit that the resultant structure of the cast product is not adversely affected.

The system for sintering molds and for preparing cast products by casting a molten metal in said molds, according to the invention, comprises a composite sintering-annealing furnace including a sintering furnace section for sintering molds therein and an annealing furnace section juxtaposed with said sintering furnace section to cool said molten metal contained in said molds at a controlled slow rate, said sintering furnace section being disposed adjacent to and separated from said annealing furnace by a partition wall and communicated with said annealing furnace section through a plurality of ventilation windows provided through said partition wall; a casting device disposed next to said sintering furnace section to cast said molten metal into said molds; and a cooling device disposed between said casting device and the entrance opening of said annealing furnace section to cool said molten metal contained in said molds rapidly to a temperature higher than the solid solution forming temperature range.

DESCRIPTION OF THE APPENDED DRAWINGS

Full understanding of the above and other objects and advantages of the invention will be had by referring to the following detailed description of a presently preferred embodiment thereof with reference to the appended drawings, in which.

DETAILED DESCRIPTION OF PREFERRED EMBODIMENT

Figure 1:
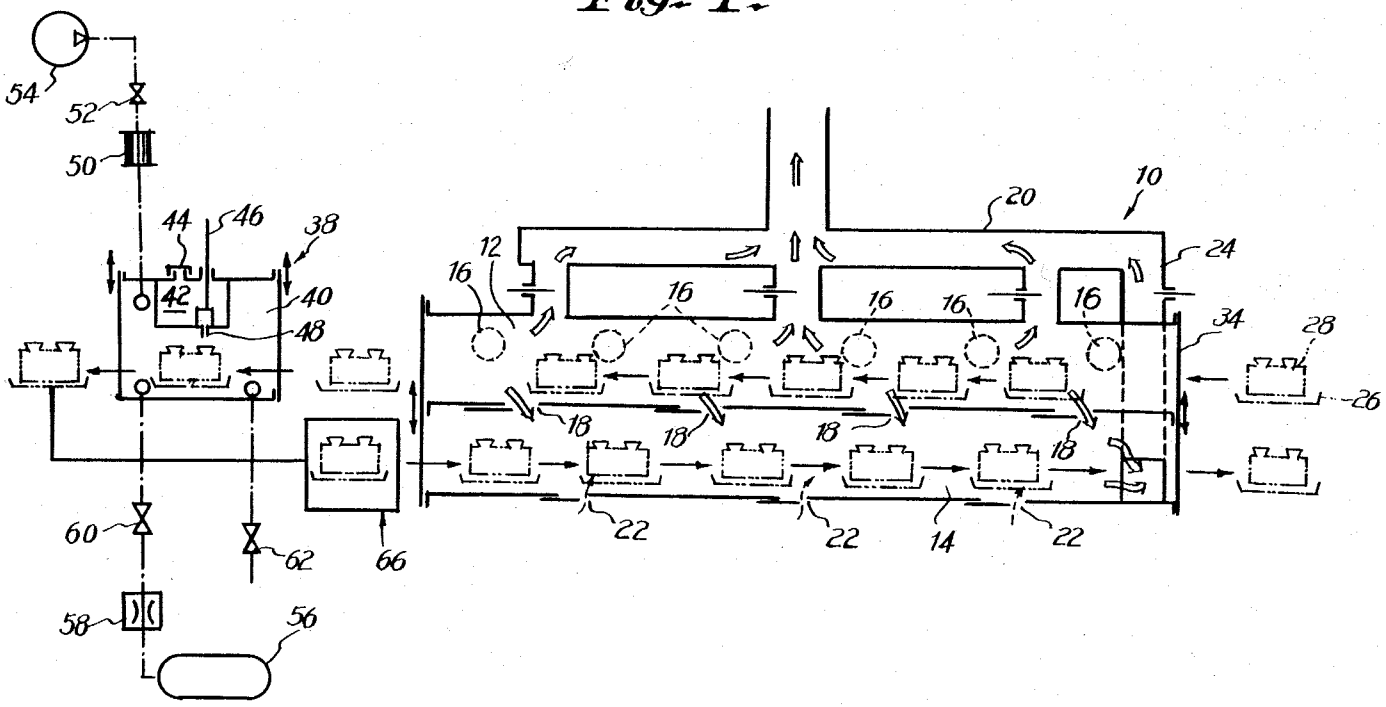
FIG. 1 is a diagrammatical view showing the general construction and arrangement of one embodiment of the invention, wherein the molds are prepared through a lost-wax casting process and a magnesium alloy is cast in the molds.
Figure 5:
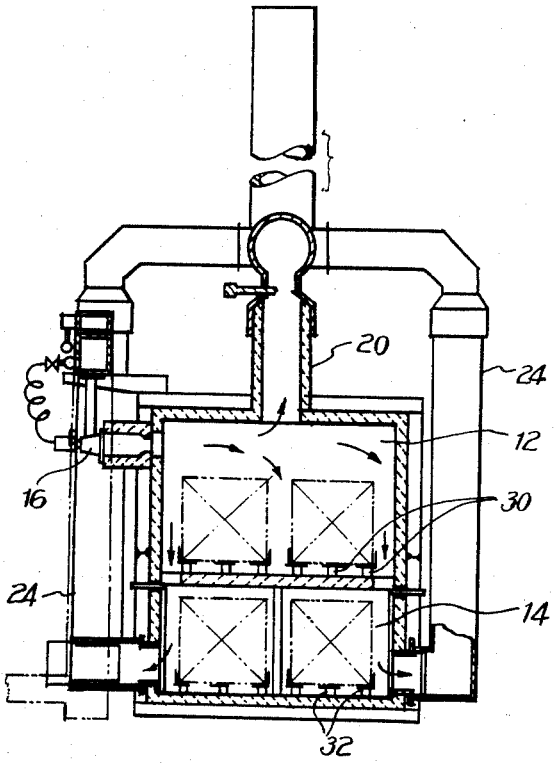
FIG. 5 is a cross-sectional view of the composite sintering-annealing furnace taken along line V—V of FIG. 2.

Referring to the drawings, a composite sintering-annealing furnace 10 includes an upper sintering furnace section 12 and a lower annealing furnace section 14, both having general configurations of tunnel. The interior of the sintering furnace section 12 is heated by a plurality of gas burners 16, as will be best seen from FIG. 1. As shown in FIGS. 1 and 5, a plurality of ventilation windows 18 are provided through a partition wall or the bottom wall of the sintering furnace section 12 to communicate the section 12 with the annealing furnace section 14. The temperature in the annealing furnace section 14 may be adjusted by changing the open areas of ports communicated to a waste gas discharge duct 20, the open areas of the ventilation windows 18, the open areas of a plurality of atmospheric air inlet ports 22 provided through the side wall of the section 14, and the open area of a port communicated to an exhaust duct 24 for the annealing furnace section 14. The open areas of respective ports or members, as aforementioned, are changed by moving in controlled fashion the adjuster plates mounted to respective ports or members to control the rate of flows passing therethrough. In detail, hot combustion gas in the sintering furnace section 12 and the atmospheric air are sucked into the annealing furnace section 14 by the action of suction pressure developed by exhausting the mixed gas in the section 14 through the exhaust duct 24. The temperature in the section 14 may be selectively controlled by changing the mixing ratio of the sucked hot combustion gas to the atmospheric air introduced into the section 14.

Two parallel conveyers 30 travel through the sintering furnace section 12 to carry thereon pallets 26 on which preformed molds 28, for instance dewaxed ceramic shell molds, are positioned, as shown in FIG. 5. Also shown in FIG. 5 are two parallel conveyers 32 which travel through the annealing furnace section 14 while carrying thereon molds 28 containing cast metal material. A door plate 34 at the entrance side of the sintering furnace section 12, i.e. the exit side of the annealing furnace section 14, is raised to open the entrance side of the section 12, and then a pushing device 36 is actuated to put pallets 26 each carrying one mold 28 one by one into the sintering furnace section 12.

A casting device, generally denoted by reference numeral 38, has a casting chamber 40 which may be closed sealingly and a ladle 42 disposed internally of the casting chamber 40. The ladle is provided with an inlet port 44 which may be sealingly closed by a lid, and a valve port 48 which may be opened or closed by moving a valve rod 46. The casting chamber 40 is evacuated through a cooler 50 and an opening-closing valve 52 by a vacuum pump 54, after a mold is put in the casting chamber 40. Reference numeral 56 designates a gas bomb in which an inert gas, such as sulfur hexafluoride ($SF_6$), or a reducing gas, such as sulfurous acid gas ($SO_2$), is contained, and the gas bomb 56 may be communicated with the casting chamber 40 through a regulator valve 58 and an opening-closing valve 60. Another valve 62 is provided for introducing the atmospheric air into the casting chamber 40 after the completion of molten metal casting operation. The casting device 38 is disposed near the exit of the upper sintering furnace section 12 together with a carrier 64.

A cooling device 66 for forcibly and rapidly cooling the mold leaving the casting chamber 40 and containing therein cast molten metal is disposed downstream of the casting device 38, and has a spot cooler for blowing cold air flows onto the exterior of the mold 28 to cool the same forcibly. The mold 28 containing the cast molten metal is lowered by means of a lift 68 to be transferred into the cooling device 66 disposed near the entrance of the annealing furnace section 14 to be rapidly cooled.

Figure 2:
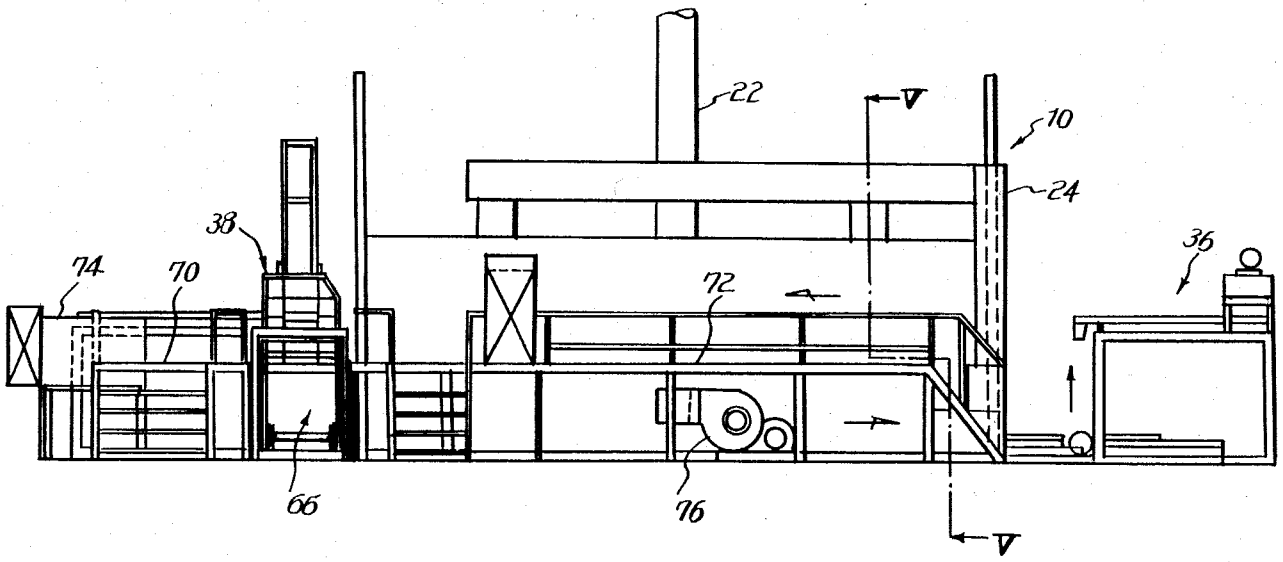
FIGS. 2 to 4 are, respectively, front, plan and right-hand side elevations of the system shown in FIG. 1.
Figure 3:
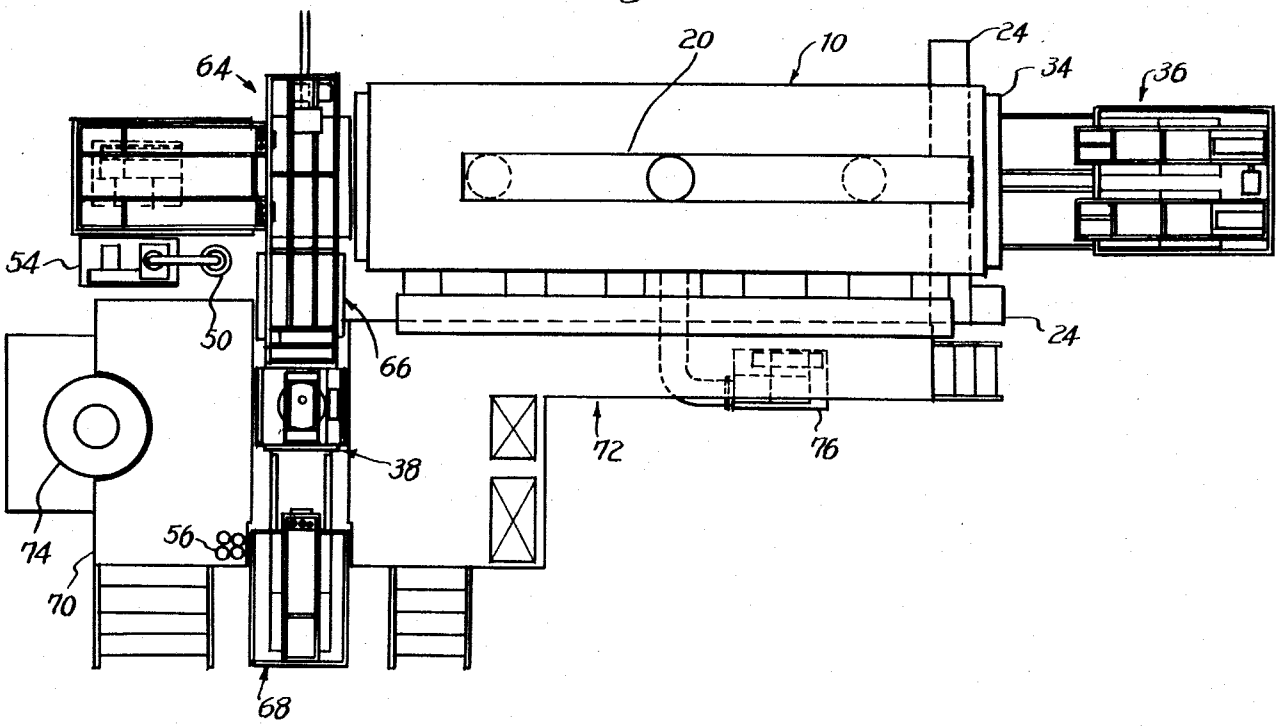
Figure 4:
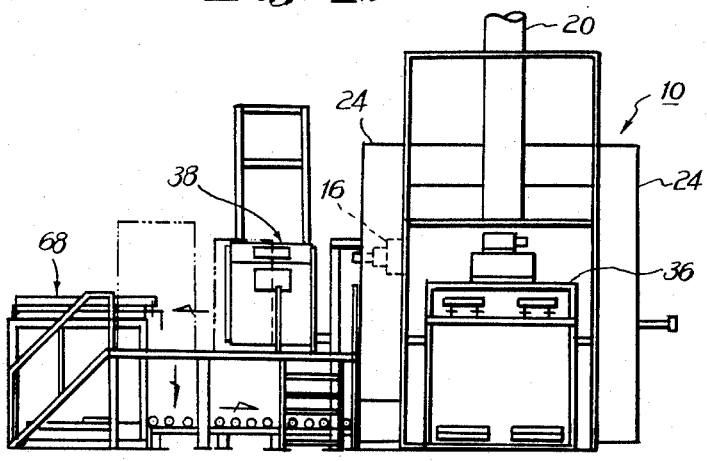

Now referring to FIGS. 2 and 3, decks 70, 72, a melting furnace 74, and a blower 76 for supplying air to the gas burners 16 are arranged as shown.

The procedure or sequential operations for casting a magnesium alloy, commonly referred to as AZ-91, in the molds using the illustrated system will now be described. The alloy AZ-91 is a casting grade magnesium alloy containing 8.1 to 9.3% of Al, 0.4 to 1.0% of Zn, and a smaller amount of each of Mn, Si, Cu and Ni, the balance being Mg. The phase diagram of this Mg-Al alloy is shown in FIG. 6.

In preparatory for casting the alloy, molds 28 are put into the sintering furnace section 12 while being carried by pallets 26 to be sintered and then maintained at a pre-set temperature (about 700° C.). On the other hand, the alloy is melted and contained at a temperature of about 800° C. with the molten bath surface covered by a smelting flux to prevent the molten alloy from burning. A predetermined quantity of the molten alloy is delivered to the ladle 42 as soon as possible, by any proper means, and the surface of the molten alloy bath in the ladle 42 is covered with a small amount of a smelting flux, followed by putting the lid on the sprue port 44. After the temperature of the molten alloy in the ladle 42 is lowered to a pre-set temperature (about 740° C. to 700° C.), one mold 28 is transferred from the sintering furnace section 12 while being carried by the pallet 26 to the casting chamber 40. Then, a strainer is put on the sprue port 44. The casting chamber 40 is sealingly closed by closing the door plates of the casting chamber 40, and then the pressure in the casting chamber 40 is reduced to a pre-set pressure, e.g. about 650 mmHg lower than the atmospheric pressure in the illustrated example, by opening the valve 52 and then actuating the vacuum pump 54. After the pressure in the chamber 40 reaches the pre-set reduced pressure level, the pump 54 is stopped and the valve 52 is opened with the valve 60 being opened to introduce a reducing gas or an inert gas into the casting chamber 40. As the pressure in the chamber 40 is increased or the degree of reduced pressure is lowered to a pre-set level (the level lower than the atmospheric pressure by about 500 mmHg), the valve rod 46 is raised to open the valve port 48, whereupon the molten alloy in the ladle 42 is poured into the mold 28. It is desirous that the casting or pouring operation is completed as fast as possible, preferably before the pressure in the casting chamber 40 reaches the level lower than the atmospheric pressure by about 450 mmHg. It is also desirous that the series of operations including the operation of delivering the molten alloy from the melting furnace 74 to the ladle 42 and the finishing operation of introducing air by opening the valve 62 have been completed within a period of less than about 2 minutes.

Figure 6:
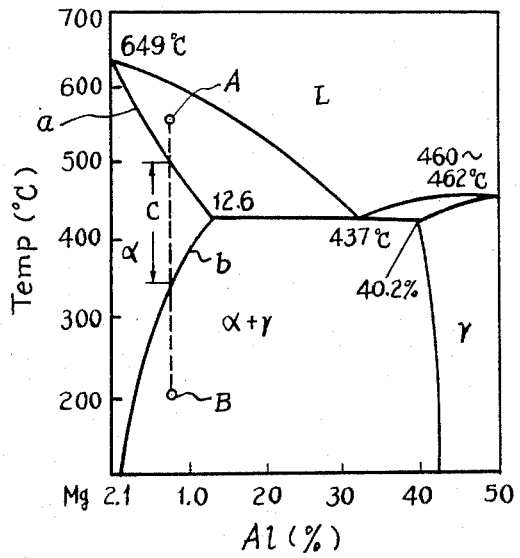
FIG. 6 is a phase diagram of an Mg-Al alloy.

Then, the lid of the casting chamber 40 is removed, and the mold 28 containing the cast molten alloy is conveyed to the cooling device 66 with the sprue port of the mold 28 being covered by the flux to cool the mold 28 and the content thereof are cooled rapidly by impinging cold air flows thereonto, whereby the molten bath of cast alloy in the mold 28 is rapidly cooled to a temperature as denoted by A in FIG. 6 (about 570° C. in the illustrated example), which temperature is higher than the α-solid solution forming temperature range as denoted by C in the Figure and enclosed by the solid phase line a and the solubility line b. Thereafter, the mold 28 is put into the annealing furnace section 14 so that the content therein is allowed to cool slowly to a temperature lower than the α-solid solution forming temperature range as shown by B in the FIG. 6 (about 200° to 300° C. in the illustrated example) over a sufficiently long time period of, for example, 60 to 90 minutes. By the rapid cooling effected prior to the subsequent slow cooling, the overall or total cooling time can be lessened with accompanying advantages that the crystallite structure becomes finer and the operation efficiency is improved. By the use of the system of the invention, the cast alloy is slowly cooled to pass across the solid solution forming temperature range (the range denoted by C in FIG. 6) where the alloy shrinks greatly, and hence the stress caused by shrinkage is adequately absorbed by the interaction with the mold 28 to prevent occurrence of cracking even at a thin wall portion. As a result, faultless cast products of high quality can be produced at high yield.

Although the operation of the present invention has been described by referring to the case where a magnesium alloy is cast, by way of example, in the preceding description, the system of the invention may be likewise utilized for the production of cast articles from any other metallic materials. It should be also appreciated that the mold 28 may be prepared through any desired processes other than the lost-wax casting process and the ceramic shell molding process.

Although the mold 28 is passed through the casting chamber 40 along the transverse direction in the illustrated embodiment, the dimensions of entire system may be further decreased to provide a more compact system which occupies a smaller installation area by an alternation wherein the bottom of the casting chamber 40 is movable toward a lower position where the mold is rapidly cooled by the cooling device.

Although the illustrated embodiment has the sintering furnace section 12 stacked or disposed over the annealing furnace section 14 and the casting device 38 placed on a plane at a substantially same height as the plane of the section 12 to ensure convenient operation as the molten mass is delivered into the ladle 42, the sintering furnace section and the casting device may be disposed on the lower plane by the provision of means for delivering the molten mass laterally from the melting furnace to the ladle. It should be noted here that the present invention embraces such a modified embodiment.

Other type alternations and modifications may be made without departing from the broad scope of the invention as defined in the appended claims.

What is claimed is:

1. A system for sintering molds and for preparing cast products by casting a molten metal in said molds, and controlling the cooling rate of said metal, said system comprising:

a sintering-annealing furnance contained within a single housing, said sintering-annealing furnance including a sintering furnace section and juxtaposed therewith an annealing furnace section, said sintering and annealing furnace sections being separated by a common partition wall with a plurality of ventilating windows therein, said sintering furnace section including section means for sintering molds therein and said annealing furnace section including cooling means for cooling said metal contained in said molds at a controlled slow cooling rate, said plurality of ventilation windows being formed in said partition walls for communicating between said annealing and said sintering furnace sections by selectively passing controlled amounts of heated air from said sintering furnace section through said plurality of ventilation windows in said partition wall to said annealing furnace said cooling means including a plurality of inlet ports, said inlet ports providing direct communication between said annealing furnance section and surrounding ambient air wherein said ventilation windows and said inlet ports are used in controlling said cooling rate within said annealing furnance section;

a casting chamber device disposed next to an output of said sintering furnace section to cast said molten metal into said molds; and a cooling device disposed between said casting device and an entrance opening of said annealing furnace to rapidly cool said molten metal contained in said molds to a temperature which is higher than the solid solution forming temperature range.

2. The system according to claim 1, wherein said sintering furnace is disposed next to said annealing furnace, and said casting device is placed on a plane at substantially a same height as a plane on which said sintering furnace section is disposed.

3. The system according to claim 1, wherein said metal is a magnesium alloy having an α-solid solution forming temperature range, and said molten metal cast in said mold is rapidly cooled to a temperature substantially higher than said α- solid solution forming temperature range.

4. The system according to claim 3, wherein said magnesium alloy cast in said mold is cooled slowly at a controlled rate in said annealing furnace section over a period of 60 to 90 minutes to pass across said solid solution forming temperature range.

5. The system according to claim 2, wherein said metal is a magnesium alloy having an α-solid solution forming temperature range, and said molten metal cast in said mold is rapidly cooled to a temperature substantially higher than said α-solid solution forming temperature range.

6. The system according to claim 1, wherein said molten metal is cast in said casting device in an inert gas atmosphere.

7. The system according to claim 6, wherein said inert gas is sulfur hexafluoride.

8. The system according to claim 2, wherein said molten metal is cast in said casting device in an inert gas atmosphere.

9. The system according to claim 1, wherein said molten metal is cast in said casting device in a reducing gas atmosphere.

10. The system according to claim 2, wherein said molten metal is cast in said casting device in a reducing gas atmosphere.

11. The system according to claim 1, wherein casting of said molten metal in said casting device is effected under a reduced pressure.

12. The system according to claim 2, wherein casting of said molten metal in said casting device is effected under a reduced pressure.

* * * * *